US006981632B2

(12) United States Patent
Gardner et al.

(10) Patent No.: US 6,981,632 B2
(45) Date of Patent: Jan. 3, 2006

(54) DISPLAY BOX

(75) Inventors: Jeffrey M. Gardner, West Chicago, IL (US); Davide R. Friedman, Prior Lake, MN (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 10/374,281

(22) Filed: Feb. 25, 2003

(65) Prior Publication Data

US 2004/0163994 A1 Aug. 26, 2004

(51) Int. Cl.
*B65D 17/00* (2006.01)

(52) U.S. Cl. ..... 229/240; 229/145; 229/103.3

(58) Field of Classification Search ..... 229/240, 229/145, 164, 103.2, 103.3; 206/738
See application file for complete search history.

(56) References Cited

U.S. PATENT DOCUMENTS 3,372,794 A * 3/1968 Kohlhaas ..... 229/123.2
3,519,194 A * 7/1970 Kohlhaas et al. ..... 229/121
3,917,158 A * 11/1975 Dorofachuk et al. ..... 229/241
4,284,193 A * 8/1981 Roccaforte ..... 206/773
4,441,614 A * 4/1984 Gulliver ..... 229/226
4,488,675 A * 12/1984 von Gnechten et al. .... 229/145
4,570,796 A * 2/1986 Groom ..... 206/449
4,907,698 A * 3/1990 Konrad et al. ..... 229/227
5,364,020 A * 11/1994 Bansal ..... 229/145
6,457,637 B1 * 10/2002 Fritz et al. ..... 229/240
6,755,306 B2 * 6/2004 Maus ..... 206/774

* cited by examiner

*Primary Examiner*—Tri M. Mai

(57) ABSTRACT

In accordance with the aspects of the present invention, a single piece container blank is disclosed. The present invention includes a blank constructed from a single sheet of foldable material cut and scored to define a bottom panel, a top panel, a front panel and a back panel. Additionally, the blank includes pairs of opposed bottom flaps, top flaps, front flaps and back flaps. A front flap tab is attached to each front flap along a front flap perforation line. A relief slot is formed between the front panel and each of the front flap tabs. The relief slots are arranged in an intersecting relationship with the front flap perforation lines. A manufacture flap is hingedly attached to the bottom panel. Opposed manufacture tabs are attached to the manufacture flap. The width of the manufacture flaps is no greater than the width of the front flap tab.

20 Claims, 5 Drawing Sheets

DISPLAY BOX

FIELD OF THE INVENTION

This invention relates generally to containers and, more specifically to corrugated display containers.

BACKGROUND OF THE INVENTION

Display containers are well known in the art. Typically, the containers are formed with either a removable top portion wherein the entire top of the container is removable or wherein only a limited section of the container is removable. Historically, containers with removable top portions use complex structure such as tear tapes or the like to facilitate the separation of the top portion from the bottom portion. Such structure is difficult to manufacture and burdensome to use. Likewise, containers with limited removable sections restrict access to the products within the container. Thus, the nature and type of product that may be placed in the container is limited.

SUMMARY OF THE INVENTION

In accordance with the aspects of the present invention, a single piece container blank is disclosed. The present invention includes a blank constructed from a single sheet of foldable material cut and scored to define a bottom panel, a top panel, a front panel and a back panel. Additionally, the blank includes pairs of opposed bottom flaps, top flaps, front flaps and back flaps. A front flap tab is attached to each front flap along a front flap perforation line. A relief slot is formed between the front panel and each of the front flap tabs. The relief slots are arranged in an intersecting relationship with the front flap perforation lines. A manufacture flap is hingedly attached to the bottom panel. Opposed manufacture tabs are attached to the manufacture flap. The width of the manufacture flaps is no greater than the width of the front flap tab.

The present invention further includes a container with opposed bottom and top panels and opposed front and back panels. The respective panels include opposed bottom flaps, opposed top flaps, opposed front flaps, and opposed back flaps. A manufacture flap is hingedly attached to the bottom panel. A pair of opposed manufacture tabs are attached to the manufacture flap. Further, a front flap tab is releasably attached to each front flap along a front flap perforation line. Each front flap tab is suitably adhered to a respective manufacture tab. The width of the manufacture flap is no greater than the width of the front flap tab. Additionally, a relief slot is formed in the front panel whereby the relief slot lies in an intersecting relation to the front flap perforation line. The manufacture flap is adjacent to but is not adhered to the front tab of the front panel.

The present invention also includes a container this is easily opened. To open the container, each front flap is pulled in any manner that will separate the front flaps from their respective front flap tabs along the front flap tab perforation lines. The container is now open. A top portion of the container may be left hingedly attached to a bottom portion. Alternatively, the top portion may be completely separated from the bottom portion by tearing along a top panel perforation line.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
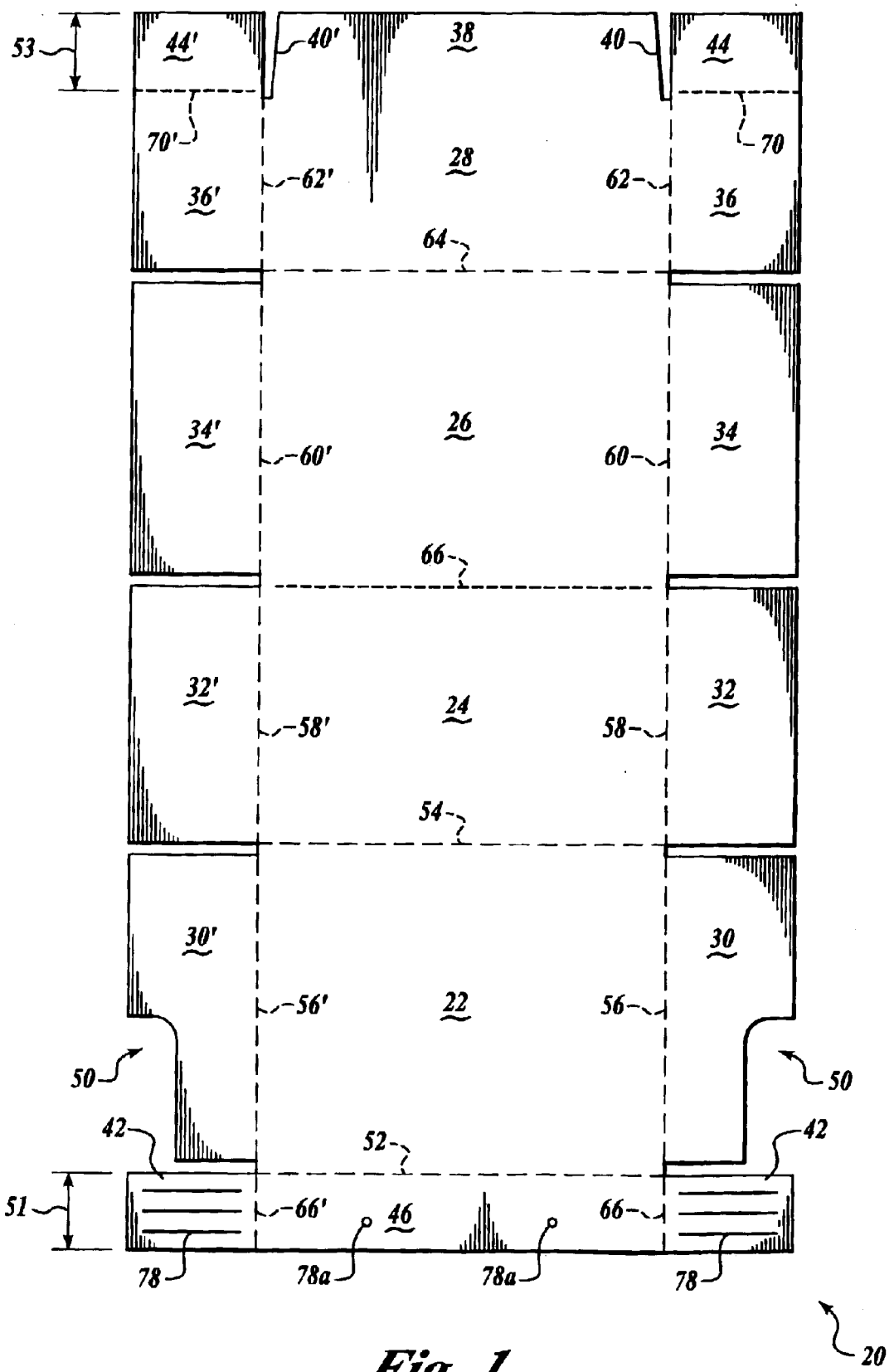
FIG. 1 is a plan view of the blank made according to the present invention.

The present invention is a blank and container for shipping and displaying products. FIG. 1 depicts the blank 20 used to form the container 48. The blank 20 is preferably constructed from a single piece of foldable material, such as, without limitation, paperboard or corrugated containerboard material. The blank 20 is cut, scored, perforated or otherwise formed to include a plurality of panels which, when assembled, create the container 48 of the present invention. Wherever possible, the same number is used in related panels of the container 48. More specifically, in all FIGURES, like numbers indicate like parts. Additionally, cuts are shown as solid lines, score lines as dashed lines and lines of perforation as broken lines. Specific details of the blank 20 and container 48 are described with more particularity below.

Figure 2:
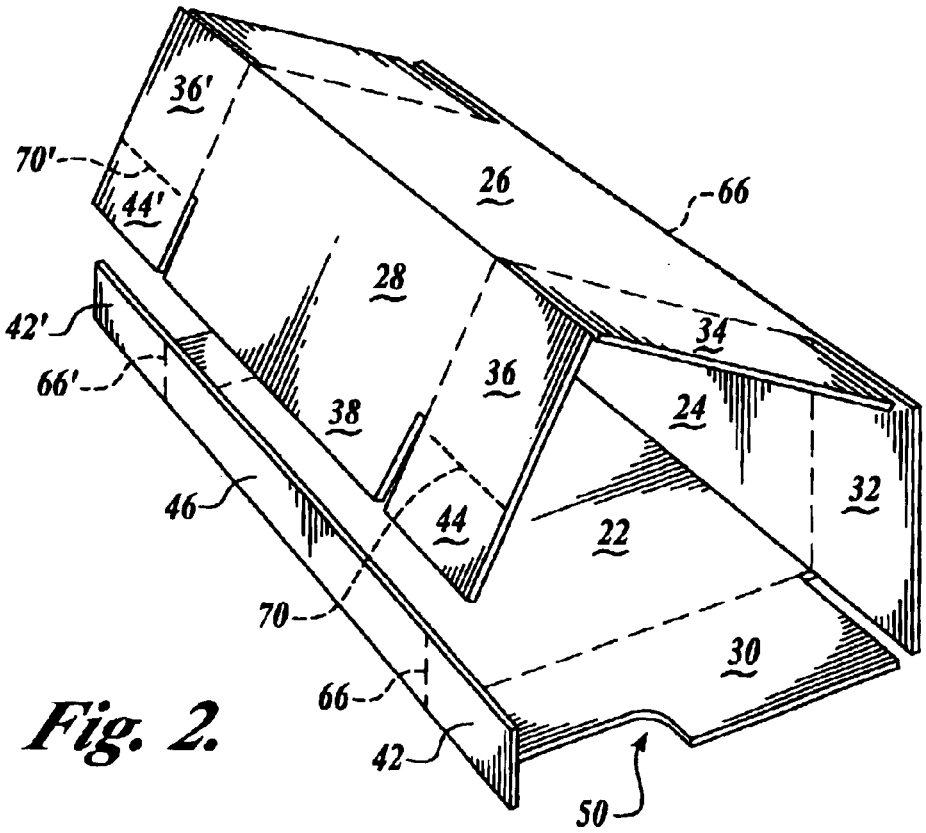
FIG. 2 is a perspective view of a partially assembled container made according to the present invention.
Figure 3:
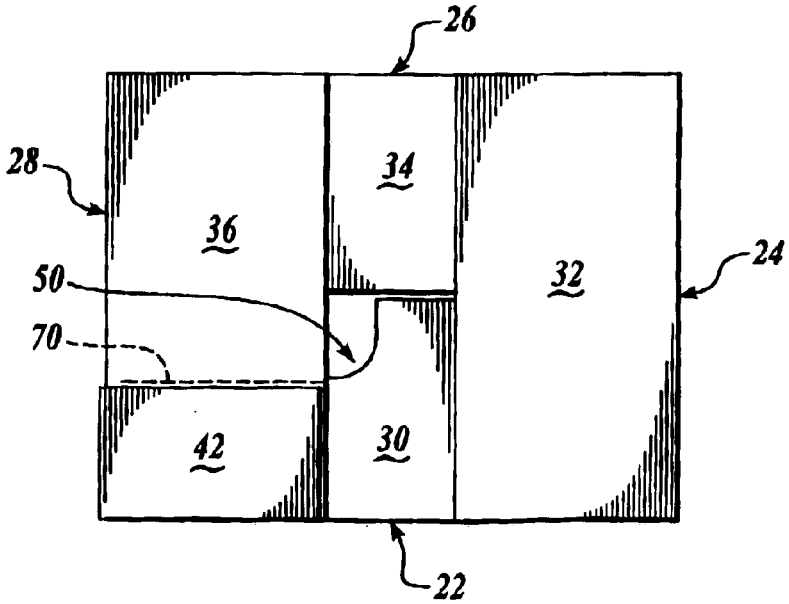
FIG. 3 is a side view of a partially assembled container made according to the present invention.
Figure 4:
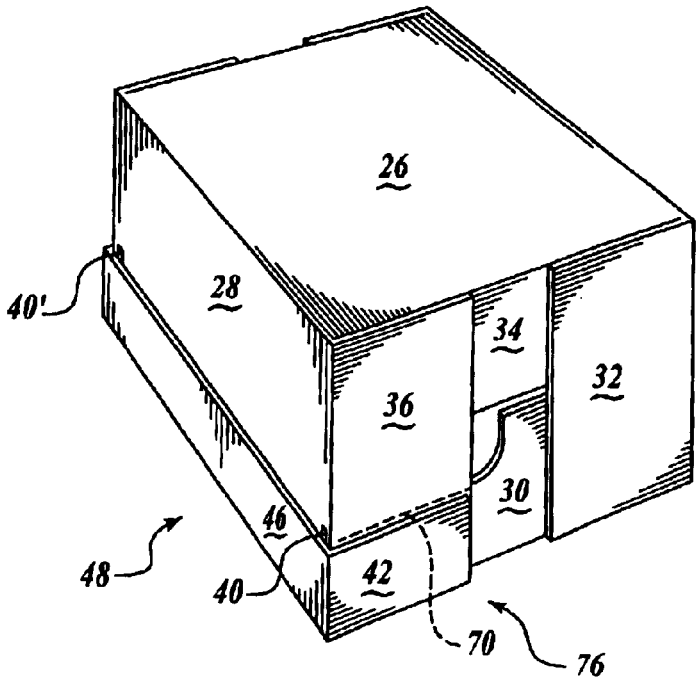
FIG. 4 is a perspective view of an assembled container made according to the present invention.
Figure 5:
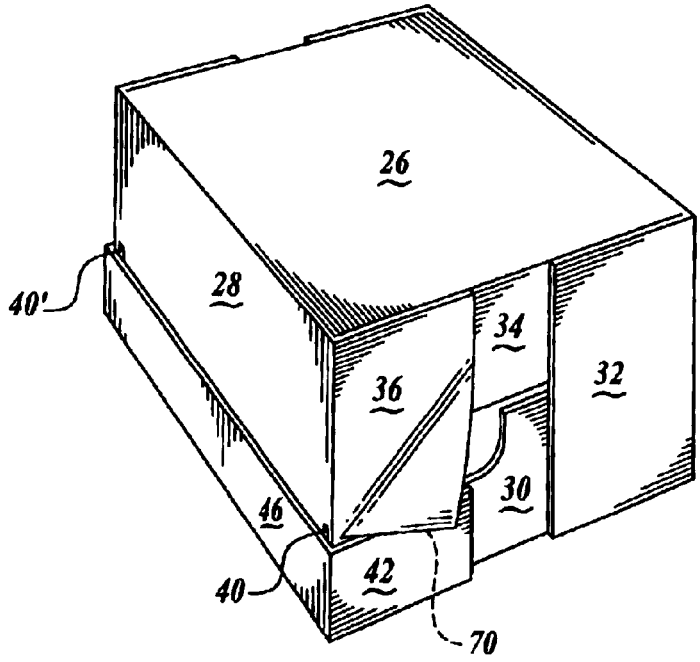
FIGS. 5 and 6 are perspective views of a method of opening the container made according to the present invention; and, FIG. 7 is a perspective view of an assembled and opened container according to the present invention.

With reference to FIGS. 2–4, the single piece blank 20 is preferably configured to form a generally rectangular or square shaped container 48. More specifically, the blank 20 is preferably configured to form a container 48 with an opposed bottom panel 22 and top panel 26, and an opposed front panel 28 and back panel 24. The bottom panel 22 includes opposed bottom flaps 30, 30'. Each of the bottom flaps 30, 30' preferably include a cutout 50, 50' located on an outer edge of each respective bottom flap 30, 30'. The back panel 24 includes opposed back flaps 32, 32'. The top panel 26 includes opposed top flaps 34, 34'. The front panel 28 includes opposed front flaps 36, 36'. Each of the bottom flaps 30, 30', back flaps 32, 32', top flaps 34, 34' and front flaps 36, 36' are suitably sized to accommodate the formation of the container 48. Such sizing is within the knowledge of those skilled in the art.

A front flap tab 44, 44' is releaseably attached to each front flap 36, 36' along a front flap perforation line 70, 70'. A pair of relief slots 40, 40' are formed in an outer edge of the front panel 28. Each relief slot 40, 40' is arranged in an intersecting relationship with each of the front flap perforation lines 70, 70'. The length of the relief slots 40, 40' is slightly greater than the width 53 of the front flap tabs 44, 44'. More specifically, the length of the relief slots 40, 40' is arranged to extend slightly beyond the intersection with the front flap perforation lines 70, 70'. In this manner, the relief slots 40, 40' extends transverse of an intersection with the front flap perforation line 70, 70'. The relief slots 40, 40' define a front tab 38 on front panel 28.

As discussed more fully below, the relationship between the relief slots 40, 40' and the front flap perforation lines 70, 70' helps facilitate opening of the container 48.

A manufacture flap 46 is attached to said bottom panel 22 along hinge line 52. The manufacture flap 46 is substantially the same length as the bottom panel 22. A pair of opposed manufacture tabs 42 are hingedly attached to the manufacture flap 46 along hinge lines 66, 66'. The width 51 of the manufacture tabs 42, 42' is preferably arranged to be no greater than the width 53 of the front flap tabs 44, 44'.

With specific reference to FIGS. 2–4, a preferable method of container 48 assembly is initiated by folding of the front panel 28 to align the front tab 38 and front flap tabs 44, 44' into an adjacent relationship with the manufacture flap 46 and manufacture tabs 42, 42', respectively. Preferably, the front tab 38 and front flap tabs 44, 44' are disposed inside the manufacture flap 46 and manufacture tabs 42, 42' when the container 48 is formed. The manufacture tabs 42, 42' are subsequently adhered solely to the front flap tabs 44, 44'.

In a presently preferred embodiment, no adhesive 78 is placed between the manufacture flap 46 and the front tab 38. However, releaseably attaching the manufacture flap 46 to the front tab 38 is also considered within the scope of this invention. By way of non-limiting example, a spot adhesive 78*a* may be placed between the manufacture flap 46 and the front tab 38. Such spot adhesive 78*a* arrangements are well known in the art.

The present invention includes a locking corner construction 76. A feature of the present invention is the lack of any adhesive 78 between the manufacture flap 46 and the front tab 38 that will interfere with opening the container 48. Those skilled in the art will appreciate that any spot adhesives 78*a* placed between the relative panels will not interfere with the operation of this invention. By pattern applying the adhesive 78 as illustrated in the present invention the container 48 is securely formed yet easily opened. The pattern applied adhesive 78 in conjunction with front flap perforation line 70, 70' and relief slots 40, 40' are an integral part of a locking corner construction 76 of the present invention. The relief slots 40, 40' allow for separation of the locking corner construction 76 when the front flap perforation lines 70, 70' are detached.

As best seen in FIGS. 3 and 4, in a preferred embodiment, the bottom flaps 30, 30' and the top flaps 34, 34' are then folded along hinge lines 56, 56' and 60, 60' respectively. Subsequently, the back flaps 32, 32' and front flaps 36, 36' are likewise folded along hinge lines 58, 58' and 62, 62', respectively. The top flaps 34, 34' are adhered to the back flaps 32, 32' in a manner that will allow for easy shearing during the opening process. A non-limiting example of a suitable adhesion of the top flaps 34, 34' to the back flaps 32, 32' includes one or more glue beads about ¼ inch to about 1 inch in length (not shown). The determination of a suitable adhesive pattern between the top flaps 34, 34' and the back flaps 32, 32' is determined by one skilled in the art. The various other flaps are suitably adhered to each other to complete the formation of the container 48.

The various panels and flaps that are adhered together in the present invention may be secured to one another in any known fashion. In a presently preferred embodiment, glue is employed to hold the panels and flaps together. However, other securing means are considered within the scope of this invention, such as without limitation, staples, tape and any other type of adhesive. The method of securing the panels together is within the scope of those skilled in the art.

In order to further illustrate the various aspects of the invention, FIGS. 4–7 show the container 48 being opened in a manner aligned with the present invention.

In a preferred embodiment, the container 48 is opened by pulling on the front flaps 36, 36' in a fashion that will facilitate separation of the front flaps 36, 36' from the front flap tabs 44, 44' along front flap perforation line 70, 70'. Those skilled in the art will appreciate the interaction between front flap perforation line 70, 70' and relief slots 40, 40'. The top flaps 34, 34' are suitably separated from the back flaps 32, 32' to open the container 48 and provide access to the enclosed product 68. The cutouts 50, 50' are provided to increase the ease in which the container 48 is opened. More specifically, the cutouts 50, 50' provide a finger hold with which to initiate opening of the container 48. As such the relative sizing and overall shape of the cutouts 50, 50' are not intended to limit the scope of the present invention. Further, cutouts 50, 50' may be located on any of the other flaps 32, 32', 34, 34' and 36, 36' alone or in any combination with the arrangement illustrated in the present invention.

Figure 6:
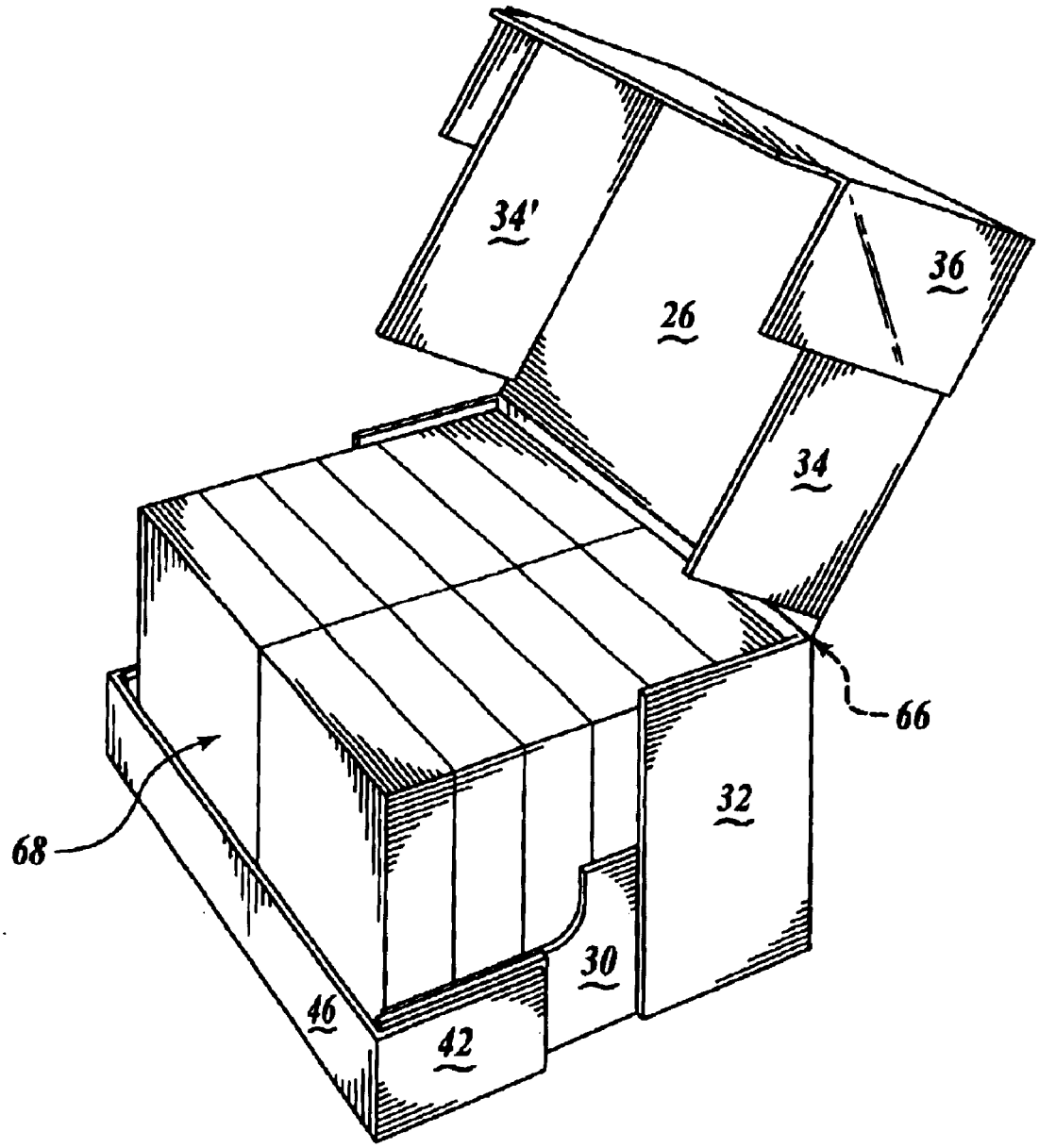
Figure 7:
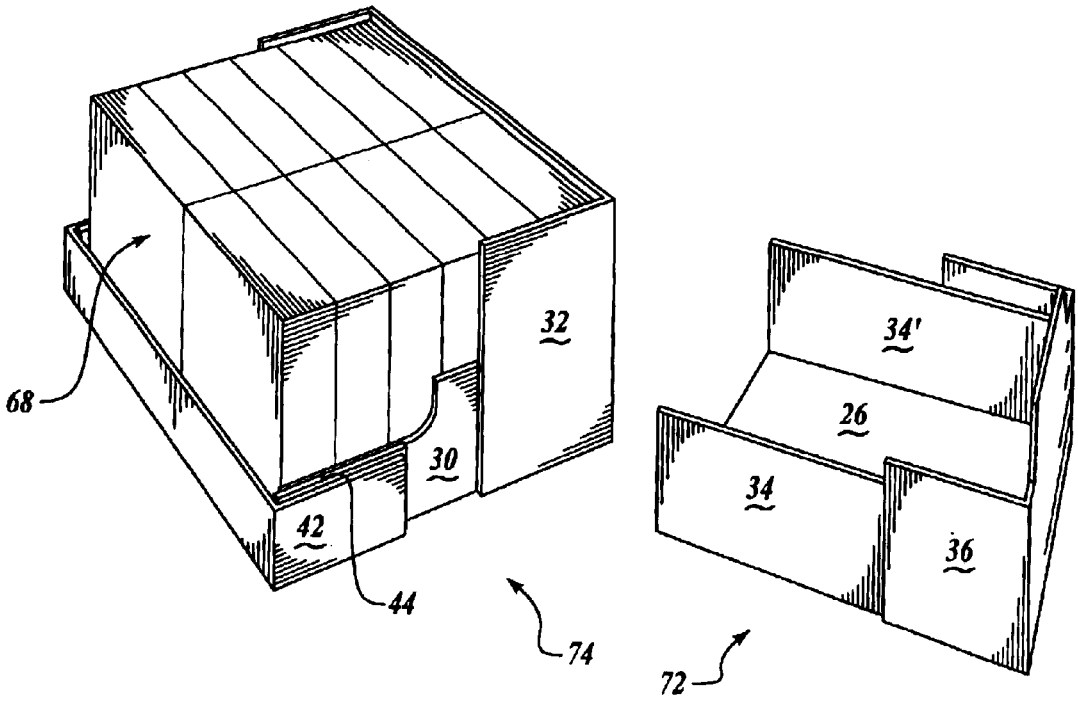

The container 48 may be used in a manner illustrated in FIG. 6. More specifically, the container 48 may be used where top assembly 72 remains hingeably connected to a bottom assembly 74 along the top panel perforation line 66. Conversely, the top assembly 72 may be completely separated from the bottom assembly 74 along the same top panel perforation line 66, as illustrated in FIG. 7. The manner in which the container 48 is employed is predominately a matter of choice for the user of the container 48.

Any variety of additional elements may be included, such as, without limitation, vents, specialized liners or grease barriers, etc., without departing from the spirit and scope of the present invention. Similarly, rounding or otherwise trimming the various panels is considered within the scope of the instant invention.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A blank for a container comprising:

a single sheet of foldable material cut and scored to define a bottom panel, a top panel, a front panel and a back panel;

opposed bottom flaps attached to said bottom panel;

opposed top flaps attached to said top panel;

opposed front flaps attached to said front pane;

opposed back flaps attached to said back panel;

a front tab attached to each front flap along a front flap perforation line;

a relief slot formed between said front panel and each of said front flap tabs, said relief slots intersecting said front flap perforation lines;

a manufacture flap hingedly attached to said bottom panel; and, opposed manufacture tabs attached to said manufacture flap, wherein the width of the manufacture flap is no greater than the width of the front flap tabs.

2. The blank of claim 1, further comprising a perforation line releasably connecting e top panel to the back panel.

3. The blank of claim 1, further comprising a cutout formed in an edge of said bottom flaps.

4. The blank of claim 1, wherein the foldable material is at least one of a paperboard and corrugated containerboard material.

5. A box locking construction comprising:

a front panel;

a front flap hingedly attached to said front panel;

a manufacture flap;

a manufacture tab hingedly attached to said manufacture flap;

a front flap tab attached to the front flap along a front flap perforation line; and, a relief slot between said front panel and said front flap tab, said relief slot intersecting said front flap perforation line;

said manufacture tab being attached solely to said front flap tab; and, said manufacture flap and said front panel not being attached.

6. The locking construction of claim 5, wherein the box is constructed of at least one of a paperboard and corrugated containerboard material.

7. The locking construction of claim 5, wherein the box is attached together by at least one of a glue, staple and tape.

8. A container comprising:

opposed bottom and top panels;

opposed front and back panels;

opposed bottom flaps attached to said bottom panel;

opposed top flaps attached to said top panel;

opposed front flaps attached to said front panel;

opposed back flaps attached to said back panel;

a manufacture flap hingedly attached to said bottom panel opposed manufacture tabs attached to said manufacture flap;

opposed front flaps attached to said front panel;

a front flap tab attached to each front flap along a front flap perforation line, said manufacture tab being adhered solely to said front flap tab; and, a relief slot formed between said front panel and each of said front flap tabs, said relief slots intersecting said front flap perforation lines.

9. The container of claim 8, wherein the width of the manufacture flap is no greater than the width of the front flap tab.

10. The container of claim 8, wherein said manufacture flap is adjacent to but not attached to said front tab.

11. The container of claim 8, wherein said top panel and said back panel are separable along a top panel perforation line.

12. The container of claim 8, further comprising cutouts formed in an outer edge of the bottom flaps.

13. The container of claim 8, wherein the container is attached together by at least one of a glue, staple and tape.

14. The container of claim 8, wherein the relief slots extends transverse of an intersection with the front flap perforation line.

15. The container of claim 8, wherein the front tab is inside of the manufacture flap.

16. A container comprising:

opposed bottom and top panels;

opposed front and back panels;

opposed bottom flaps attached to said bottom panel;

opposed top flaps attached to said top panel;

opposed front flaps attached to said front panel;

opposed back flaps attached to said back panel;

a manufacture flap hingedly attached to said bottom panel opposed manufacture tabs attached to said manufacture flap;

opposed front flaps attached to said front panel;

a front flap tab attached to each front flap along a front flap perforation line, said manufacture tabs being attached solely to said front flap tab; and, a relief slot formed between said front panel and each of said front flap tabs, said relief slots intersecting said front flap perforation lines;

wherein said manufacture flap is releaseably attached to said front tab.

17. The container of claim 16, wherein said top panel and said back panel are separable along a top panel perforation line.

18. The container of claim 16, further comprising cutouts formed in an outer edge of the bottom flaps.

19. The container of claim 16, wherein the container is attached together by at least one of a glue, staple and tape.

20. The container of claim 16, wherein the front panel is inside of the manufacture flap.

* * * * *

UNITED STATES PATENT AND TRADEMARK OFFICE

CERTIFICATE OF CORRECTION

PATENT NO. : 6,981,632 B2
DATED : January 3, 2006
INVENTOR(S) : Gardner et al.

It is certified that error appears in the above-identified patent and that said Letters Patent is hereby corrected as shown below:

Column 4,
Line 60, change "e" to -- the --.

Signed and Sealed this

Fourth Day of April, 2006

JON W. DUDAS
*Director of the United States Patent and Trademark Office*